US011300134B2

(12) United States Patent
Umematsu

(10) Patent No.: US 11,300,134 B2
(45) Date of Patent: Apr. 12, 2022

(54) BLOWER

(71) Applicant: SHINANO KENSHI KABUSHIKI KAISHA, Nagano (JP)

(72) Inventor: Akishige Umematsu, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 0 days.

(21) Appl. No.: 16/773,312

(22) Filed: Jan. 27, 2020

(65) Prior Publication Data

US 2020/0300261 A1 Sep. 24, 2020

(30) Foreign Application Priority Data

Mar. 22, 2019 (JP) ..... JP2019-054104

(51) Int. Cl.

| | |
|---|---|
| ***F04D 29/28*** | (2006.01) |
| ***F04D 17/16*** | (2006.01) |
| ***F04D 29/30*** | (2006.01) |
| ***F04D 29/44*** | (2006.01) |

(Continued)

(52) U.S. Cl.

CPC ..... *F04D 29/281* (2013.01); *F04D 17/08* (2013.01); *F04D 17/16* (2013.01); *F04D 29/30* (2013.01); *F04D 29/4206* (2013.01); *F04D 29/4226* (2013.01); *F04D 29/4233* (2013.01); *F04D 29/441* (2013.01); *F05B 2240/301* (2013.01)

(58) Field of Classification Search

CPC .... F04D 29/281; F04D 29/30; F04D 29/4226; F04D 29/4233; F04D 17/08; F04D 29/4206; F04D 29/441; F04D 17/16

See application file for complete search history.

(56) References Cited

U.S. PATENT DOCUMENTS 2,207,317 A * 7/1940 Gear ..... F04D 29/167 415/97
3,384,026 A * 5/1968 Williamson, Jr. .. F04D 29/2244 415/143

(Continued)

FOREIGN PATENT DOCUMENTS

| | | |
|---|---|---|
| CN | 2531147 | 1/2003 |
| DE | 10 2008 048433 | 3/2010 |

(Continued)

OTHER PUBLICATIONS

Office Action dated Nov. 17, 2020 in Japanese Application No. 2019-054104.

(Continued)

*Primary Examiner* — Peter J Bertheaud
(74) *Attorney, Agent, or Firm* — Stephen J. Weyer, Esq.; Stites & Harbison, PLLC

(57) ABSTRACT

There is provided a blower realizing characteristics in which the pressure is reduced as the flow rate is increased in pressure-flow rate characteristics in a case where an impeller rotates at a fixed rotation speed, while having a simple structure. An impeller includes a main plate formed in a disc shape and a plurality of main blades formed to stand on the main plate, the impeller is extended to a position facing the inside of a discharge flow path formed so as to circle on an outer peripheral side, and auxiliary blades are formed to stand on an extended portion extended inside the discharge flow path.

4 Claims, 10 Drawing Sheets

(51) Int. Cl.
*F04D 29/42* (2006.01)
*F04D 17/08* (2006.01)

(56) References Cited

U.S. PATENT DOCUMENTS

| | | | | |
|---|---|---|---|---|
| 3,973,866 | A * | 8/1976 | Vaughan | F04D 7/045 415/121.1 |
| 4,664,592 | A | 5/1987 | Grzina | |
| 4,883,403 | A * | 11/1989 | Walker | F04D 29/2266 415/98 |
| 5,855,469 | A * | 1/1999 | McConnell | F01D 11/10 415/171.1 |
| 6,224,335 | B1 * | 5/2001 | Parisi | F04D 29/162 415/206 |
| 2013/0230421 | A1 * | 9/2013 | Teramoto | F04D 23/008 417/423.14 |
| 2015/0308446 | A1 | 10/2015 | Koivikko et al. | |

FOREIGN PATENT DOCUMENTS

| | | |
|---|---|---|
| EP | 2 940 307 | 11/2015 |
| JP | S53-47605 | 4/1978 |
| JP | 2004-204756 | 7/2004 |
| JP | 2016017461 | 2/2016 |
| WO | WO-8802820 | 4/1988 |
| WO | WO-2018135069 | 7/2018 |

OTHER PUBLICATIONS

Office Action dated Dec. 22, 2020 in Japanese Application No. 2019-054104.

Extended European Search Report dated Aug. 8, 2020 in Application No. 20155282.5.

* cited by examiner

BLOWER

CROSS-REFERENCE TO RELATED APPLICATION

This application is based upon and claims the benefit of priority of the prior Japanese Patent Application No. 2019-054104, filed on Mar. 22, 2019, and the entire contents of which are incorporated herein by reference.

TECHNICAL FIELD

The present disclosure relates to a blower, which is used for medical equipment, industrial equipment, consumer equipment or the like.

BACKGROUND ART

With respect to a centrifugal blower (turbo fan) used in the past, when a flow rate is increased in a low flow rate region in a pressure-flow rate characteristics under a fixed rotation speed, the pressure is increased. However, when the flow rate is increased in a high flow rate region in which the flow rate and the pressure are high to some degree, characteristics that the pressure is reduced contrary to the above are exhibited. With respect to a blower having such pressure-flow rate characteristics, operations for controlling the pressure and the flow rate are complicated, and for maintaining the fixed pressure, for example, it is necessary to constantly monitor a motor rotation speed, the pressure, and the flow rate.

In order to prevent a blower fan from moving in a thrust direction due to a pressure difference between an upper surface side and a lower surface side of the blower fan, convex parts and concave grooves are provided on the lower surface side as an opposite surface to the upper surface side on which blades are provided, thereby generating an airflow on the lower surface side to solve the pressure difference, though not for improving the pressure-flow rage characteristics (refer to PTL 1: WO2018/135069).

In order to expand an operation area on the high flow rate's side of a centrifugal compressor, there is also provided a technique of providing a shelf portion in which a blade thickness of a blade part of an impeller is gradually changed from a root portion to an end portion, and a reduction ratio of the blade thickness in the shelf portion is larger than a reduction ratio of the blade thickness in the root portion and a reduction ratio of the blade thickness in the end portion, thereby expanding the operation area on the high flow rate's side (refer to PTL 2: JP-A-2016-17461).

SUMMARY OF INVENTION

Technical Problem

However, characteristics not like the above characteristics may be requested in the pressure-flow rate characteristics in the case where the impeller rotates at a fixed rotation speed, in which the pressure is higher in the low flow rate region from the beginning, and the pressure is reduced as the flow rate is increased in the whole flow rate region.

As a method of realizing the characteristics, there is a method of increasing a gap between the impeller and a casing. However, in this method, blow back from an inner wall surface of a flow path toward the impeller is increased, so that efficiency is reduced, and additionally, the casing is increased in size.

In the method of managing the plate thickness of blades forming the centrifugal fan one by one on the root side and the end side as in PTL 2, the shape is complicated and the molding is difficult, which lead to increase in manufacturing costs.

Solution to Problem

In response to the above issue, one or more aspects of the present invention are directed to a blower which realizes characteristics in which the pressure is reduced as the flow rate is increased in the pressure-flow rate characteristics in a case where the impeller rotates at a fixed rotation speed, while having a simple structure.

In view of the above, the following embodiments are described below.

In a blower in which an impeller and a motor driving the impeller to rotate are housed in housings, and outside air is sucked from an intake port provided at a central part in the housings in an axial direction by rotation of the impeller and is discharged from a discharge port of a discharge flow path scrolling on an outer side in a radial direction, the impeller includes a main plate formed in a disc shape and a plurality of main blades formed to stand on the main plate, the impeller is extended to a position facing the inside of the discharge flow path formed so as to circle on an outer peripheral side, and auxiliary blades are formed to stand on an extended portion extended inside the discharge flow path.

According to the above structure, outside air is sucked from the intake port of the housing by rotation of the impeller and guided by the main blades to be fed to the discharge flow path circling on the outer peripheral side after being accelerated. Moreover, fluid returning to the impeller along an inner wall surface of the discharge flow path is guided by the auxiliary blades and can be accelerated and fed to the discharge flow path along an outer peripheral edge portion of the main plate facing the discharge flow path. Accordingly, the lower the flow rate is, the longer the time during which the fluid exists in the discharge flow path is in the pressure-flow rate characteristics when the impeller rotates at a given rotation speed; therefore, the effect of acceleration by the auxiliary blades is increased, and thus the pressure can be increased. Moreover, the higher the flow rate is, the shorter the time during which the fluid exists in the discharge flow path is; therefore, the effect of acceleration by the auxiliary blades is reduced, and thus the effect of increasing the pressure is reduced. As a result, the characteristics in which the pressure is reduced as the flow rate is increased can be realized.

It is preferable that the auxiliary blades are integrally formed to stand at least on the main plate or a main blade shroud in which respective standing end surfaces of the main blades are connected in a circumferential direction.

After outside air is sucked from the intake port of the housing and guided by the main blades to be accelerated and fed to the circling discharge flow path, the fluid returning to the main blade shroud along the wall surface of the discharge flow path can be accelerated again by the auxiliary blades provided on any of the main plate and the main blade shroud and can be fed to the discharge flow path.

The outer peripheral edge portion of the main plate may be formed to be curved toward the inside of the discharge flow path.

Accordingly, the fluid returning to the impeller along the wall surface of the discharge flow path can be easily guided to the discharge flow path.

The auxiliary blades may be formed on both of the main plate and the main blade shroud.

Accordingly, the fluid returning to an outer peripheral edge portion of the impeller along the wall surface of the discharge flow path can be accelerated again by the auxiliary blades respectively provided on both surfaces of the main plate and the main blade shroud and can be fed to the discharge flow path.

Respective standing end surfaces of the auxiliary blades may be connected in the circumferential direction to integrally form an auxiliary blade shroud.

Accordingly, the fluid returning to the impeller along the wall surface of the discharge flow path can be easily fed to the discharge flow path after being guided between the auxiliary blade shroud and the main plate efficiently and accelerated again by the auxiliary blades.

A housing-side auxiliary shroud fixed to the housing may be formed at a position facing the auxiliary blades inside the discharge flow path provided in the housing.

Accordingly, the fluid returning to the impeller along the wall surface of the discharge flow path can be easily fed to the discharge flow path after being guided between the housing-side auxiliary shroud fixed to the housing and the main plate efficiently and accelerated again by the auxiliary blades.

Advantageous Effects of Invention

It is possible to provide a blower capable of realizing characteristics in which the pressure is reduced as the flow rate is increased in the pressure-flow rate characteristics when the impeller rotates at a fixed rotation speed.

DESCRIPTION OF EMBODIMENTS

Figure 1A:
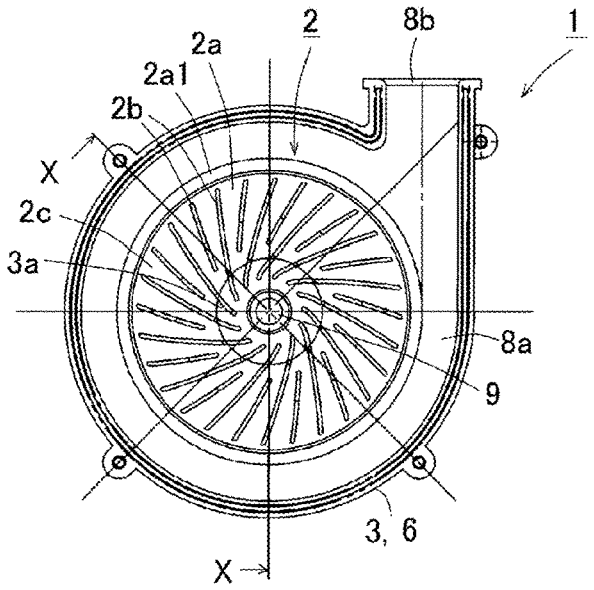
FIGS. 1A to 1C are a plan view in an axial direction of a blower from which a first housing is removed, a cross-sectional view taken along a direction of arrows X-X, and a back view of an impeller, respectively.

Hereinafter, a blower according to an embodiment of the present invention will be explained with reference to the attached drawings. First, an outline structure of the blower will be explained with reference to FIGS. 1A to 1C to FIGS. 3A to 3C.

A blower 1 has the following structure. As shown in FIG. 1B, a first housing 3 housing an impeller 2 and a second housing 6 housing a stator 4 and a rotor 5 (a motor M) are integrally screw-fixed by a bolt 8*c*, and a bracket 7 is integrally assembled to a bottom part of the second housing 6 by being screw-fixed by a bolt 8*d* to form a case body 8. A seal material is sandwiched at an abutting end surface between the first housing 3 and the second housing 6, and a discharge flow path 8*a* (scroll) may be formed in a sealed manner. The impeller 2 and the rotor 5 are respectively and integrally assembled with a rotor shaft 9 pivotally supported so as to rotate inside the case body 8.

Figure 1B:
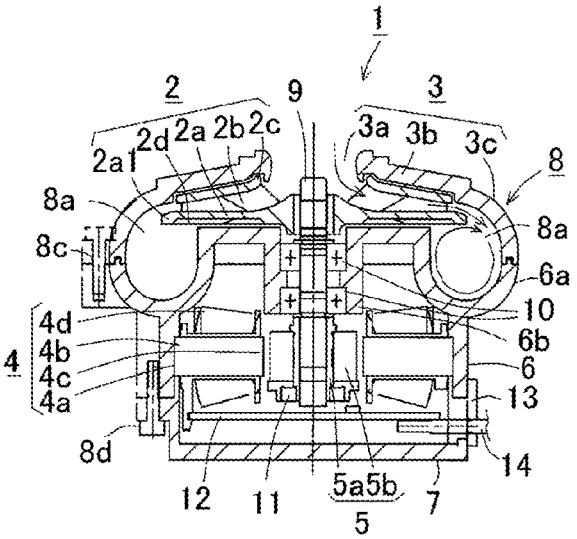
Figure 1C:
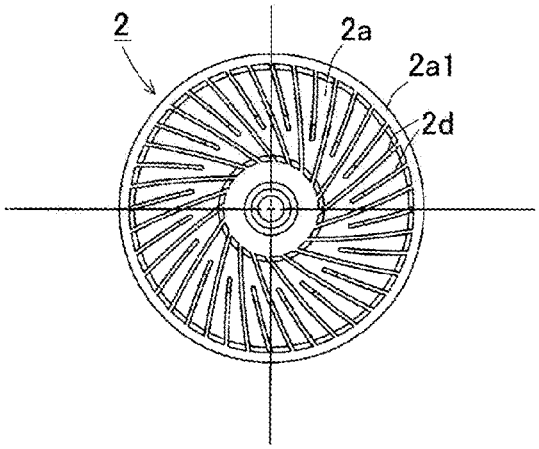

As shown in FIG. 1A, an intake port 3*a* is formed at a central part of the first housing 3 and a tubular bearing holding portion 6*b* is integrally formed at a central part of the second housing 6 so as to correspond to the intake port 3*a*. A housing-side shroud 3*b* is formed near the intake port 3*a*. The housing-side shroud 3*b* is formed so as to correspond to the impeller 2, forming a blowing passage toward an outer side in a radial direction. A first curved portion 3*c* is continuously formed from the housing-side shroud 3*b*. In the second housing 6 facing the first curved portion 3*c*, a second curved portion 6*a* is provided. The discharge flow path 8*a* circling (scrolling) on an outer peripheral side of the impeller 2 is formed by combining end parts of the first curved portion 3*c* and the second curved portion 6*a* with each other. The discharge flow path 8*a* in the present embodiment is arranged to be biased to the second housing 6 from the impeller 2 in an axial direction. Compressed air discharged to the discharge flow path 8*a* formed in the case body 8 is accelerated and discharged from a discharge port 8*b* (see FIG. 1A).

As shown in FIG. 1B, the impeller 2 is integrally assembled to one end of the rotor shaft 9. In the present embodiment, an outer peripheral edge portion 2*a*1 of a main plate 2*a* that forms the impeller 2 in a lower direction of the impeller 2 in the axial direction is provided to extend to the discharge flow path 8*a*. A middle part of the rotor shaft 9 is rotatably supported by a pair of bearings 10 provided inside the bearing holding portion 6*b*. A rolling bearing (ball bearing) is preferably used for the bearings 10. A sliding bearing (for example, a fluid dynamic pressure bearing or the like) may be used instead of the rolling bearing.

The rotor 5 is assembled to the other end side of the rotor shaft 9. Specifically, a rotor magnet 5*b* is concentrically attached to the rotor shaft 9 through a rotor yoke 5*a*. N-poles and S-poles are alternately magnetized in the rotor magnet 5*b* in a circumferential direction. A sensor magnet 11 is attached to the other end side of the rotor shaft 9.

In FIG. 1B, the motor M is housed in the second housing 6. Specifically, the stator 4 is assembled inside the second housing 6. An annular core-back portion 4*b* is fixed and a stator core 4*a* is assembled to an inner wall surface of the second housing 6. Pole teeth 4*c* are provided to protrude at plural places from the annular core-back portion 4*b* to an inner side in the radial direction. Coils 4*d* are wound around respective pole teeth 4*c*. The pole teeth 4*c* of the stator core 4*a* are arranged so as to face the rotor magnet 5*b*. Moreover, a motor substrate 12 is provided in a bottom portion of the second housing 6, and coil leads pulled out from respective coils 4*d* are connected thereto.

As shown in FIG. 1B, a grommet 13 is attached to an opening formed between end surfaces of the second housing 6 and the bracket 7. A lead wire 14 is taken out to the outside through the grommet 13 so that power is fed.

Figure 2A:
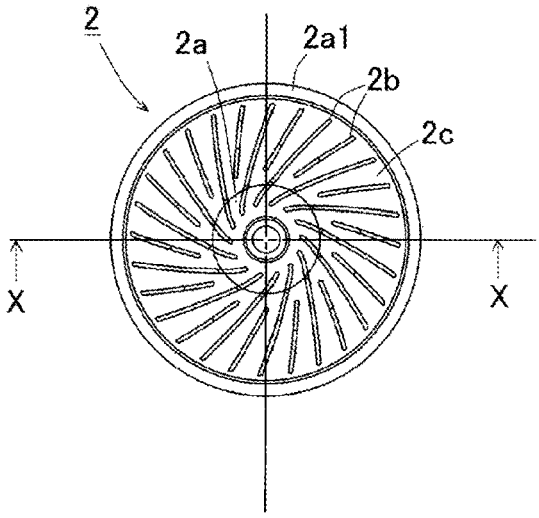
FIG. 2A to 2C are a plan view, a cross-sectional view taken along X-X direction, and a back view, of the impeller of FIGS. 1A to 1C, respectively.
Figure 2B:
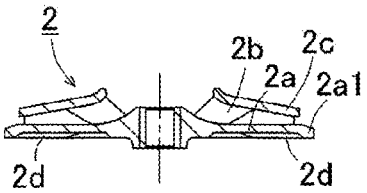
Figure 2C:
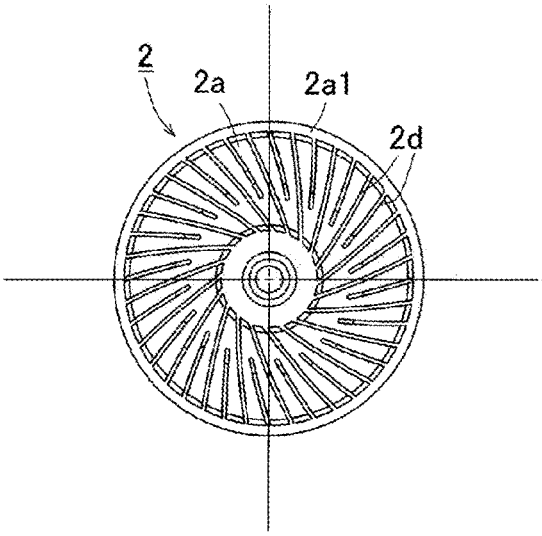

As shown in FIGS. 2A, 2B, and 2C, the impeller 2 has the disc-shaped main plate 2*a*. The outer peripheral edge portion 2*a*1 of the main plate 2*a* is provided to extend to a position facing the inside of the discharge flow path 8*a* formed so as to circle on the outer peripheral side of the impeller 2. According to the above structure, outside air is sucked from the intake port 3*a* of the first housing 3 by rotation of the impeller 2, being guided by main blades 2*b* and fed to the discharge flow path 8*a* circling on the outer peripheral side after being accelerated. Fluid returning to the impeller 2 along an inner wall surface of the flow path can be fed to the discharge flow path 8*a* along the outer peripheral edge portion 2*a*1 of the main plate 2*a* facing the discharge flow path 8*a*.

On the main plate 2*a*, the main blades 2*b* are formed to stand at plural places from a central part toward outer peripheral directions (see FIG. 2B). As shown in FIG. 2A, blades with a long length extending from the vicinity of a shaft hole of the main plate 2 to the outer peripheral edge portion and blades with a short length extending from a middle part of the main plate 2*a* in the radial direction to the outer peripheral edge portion are alternately formed as the main blades 2*b*. FIG. 2A is a view seen through a later-described main blade shroud 2*c*. As shown in FIG. 2B, the main blade shroud 2*c* covering respective standing end surfaces of the main blades 2*b* in the circumferential direction is integrally formed. A space surrounded by the main plate 2*a*, the main blades 2*b* and the main blade shroud 2*c* will be a blowing space connecting to the discharge flow path 8*a*. The outer peripheral edge portion 2*a*1 of the main plate 2*a* may be formed to be curved toward the discharge flow path 8*a*. Accordingly, the fluid returning to the impeller 2 along a wall surface of the discharge flow path (the first curved portion 3*c* and the second curved portion 6*a*) can be easily guided to the discharge flow path 8*a* again. It is also possible to obtain an effect of reducing noise when the outer peripheral edge portion 2*a*1 of the main plate 2*a* is curved toward the inside of the discharge flow path 8*a*.

As shown in FIG. 2C, it is desirable that auxiliary blades 2*d* are formed to stand at least in the outer peripheral edge portion 2*a*1 facing the discharge flow path 8*a* on an opposite surface to a surface of the main plate 2*a* where the main blades 2*b* are formed. As the auxiliary blades 2*d*, blades with a long length extending from the vicinity of the shaft hole of the main plate 2 to the outer peripheral edge portion 2*a*1 and blades with a short length extending from a middle part of the main plate 2*a* in the radial direction to the outer peripheral edge portion 2*a*1 are alternately formed. The auxiliary blades 2*d* are integrally molded at the time of resin-molding the impeller 2.

Accordingly, the fluid fed from the impeller 2 into the discharge flow path 8*a* and returning to the impeller 2 along the inner wall surface of the discharge flow path can be accelerated and fed to the discharge flow path 8*a* again by the auxiliary blades 2*d* formed to stand on the outer peripheral edge portion 2*a*1 facing the discharge flow path 8*a*.

Figure 3A:
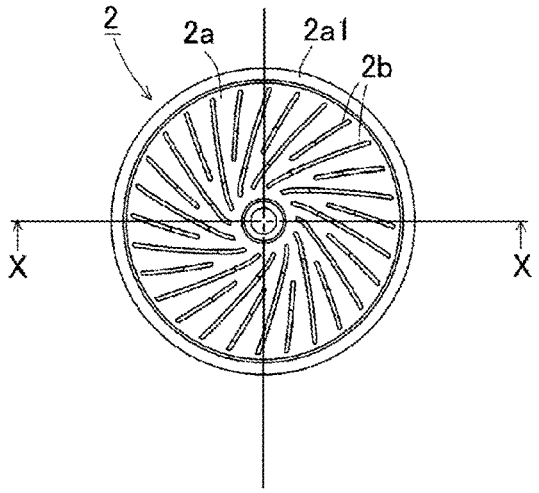
FIGS. 3A to 3C are a plan view, a cross-sectional view taken along X-X direction, and a back view, of an impeller according to another example, respectively.
Figure 3B:
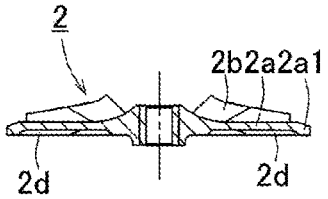
Figure 3C:
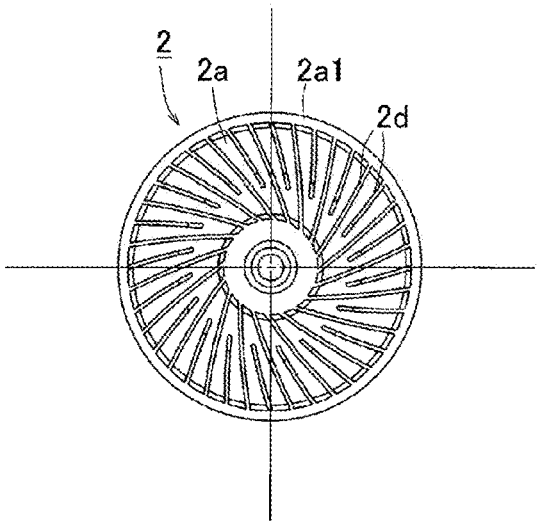

As shown in FIGS. 3A, 3B, and 3C, the main blade shroud 2*c* covering the respective main blades 2*b* in the circumferential direction may be omitted in the impeller 2. In this case, a space surrounded by the main plate 2*a*, the main blades 2*b* and the housing-side shroud 3*b* will be a blowing space connecting to the discharge flow path 8*a*.

As shown in FIG. 1B, when the motor M is activated, the blower 1 sucks outside air from the axial direction of the intake port 3*a* in the first housing 3 by the rotation of the impeller 2, and the outside air is guided by the main blades 2*b* by the rotation of the impeller 2, then, accelerated and fed to the discharge flow path 8*a* circling on the outer peripheral side. The fluid returning to the impeller 2 along the inner wall surface of the flow path at this time can be accelerated again by the auxiliary blades 2*d* formed to stand on the outer peripheral edge portion facing the discharge flow path 8*a* and fed to the discharge flow path 8*a*.

Figure 4:
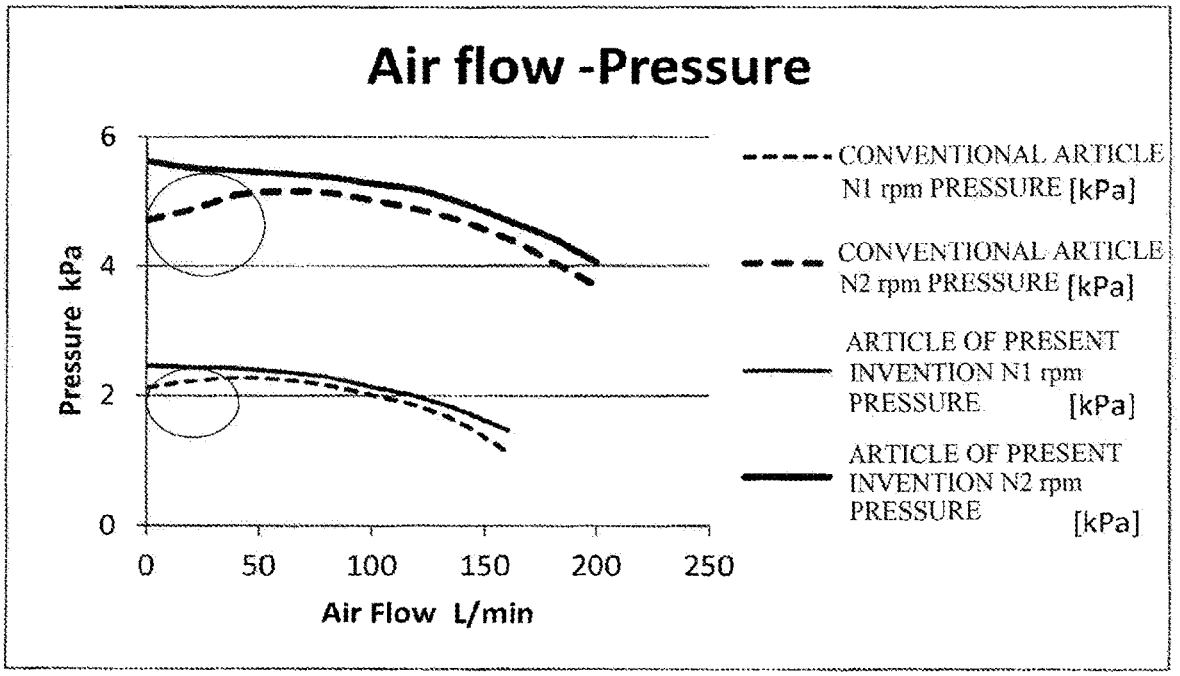
FIG. 4 is a graph chart showing comparison in pressure-flow rate characteristics between an example according to the present invention and a conventional example.

FIG. 4 is a graph chart showing comparison in pressure-flow rate characteristics between an example according to the present invention and a conventional example.

Broken-line graphs in FIG. 4 show characteristics of a conventional article, specifically, indicating pressure-flow chart characteristics when the rotation speed of the impeller is N1 rpm and when the rotation speed is N2 rpm which is higher than N1. Curves are drawn to indicate that the pressure is increased at an approximately constant rate as the flow rate is increased in a low flow rate region in which air starts to flow, and that the pressure is reduced as the flow rate is increased in a high flow rate region in which the flow rate and the pressure are increased to some degree. The low flow rate region and the high flow rate region differ according to the rotation speed. The low flow rate region and the high flow rate region are divided in the vicinity of a flow rate at which the pressure is the highest.

On the other hand, solid-line graphs in FIG. 4 show characteristics of an example according to the present invention, specifically, indicating pressure-flow chart characteristics when the rotation speed of the impeller is N1 rpm and when the rotation speed is N2 rpm in the case where the auxiliary blades 2*d* are provided. According to the present invention, curves are drawn to indicate that the pressure is the highest at the beginning of flowing and that the pressure is reduced as the flow rate is increased.

Accordingly, it is found that characteristics in the low flow rate region where circles are put on the broken-line graphs of the conventional article are improved in the example according to the present invention.

As described above, it is possible to realize characteristics in which the pressure is reduced as the flow rate is increased in the pressure-flow rate characteristics in the case where the impeller 2 rotates at a given rotation speed.

Figure 5A:
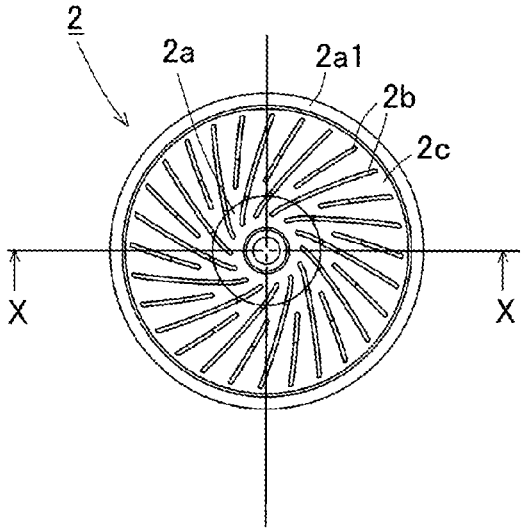
FIGS. 5A to 5C are a plan view, a cross-sectional view taken along X-X direction, and a back view, of an impeller according to another example, respectively.
Figure 5B:
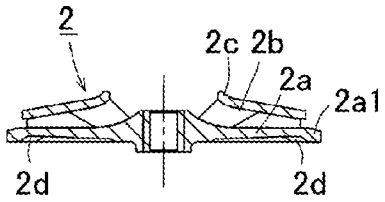

Next, structures of the impeller and the blower according to other examples will be explained with reference to FIGS. 5A to 5C to FIG. 9. FIGS. 5A to 5C and FIGS. 6A to 6C illustrate plan views, cross-sectional views taken along X-X direction and back views of the impeller according to other examples. The same signs are given to the same members as those of the impeller 2 shown in FIGS. 2A to 2C and the explanation thereof is invoked. The main blades 2*b* and the main blade shroud 2*c* covering respective standing end surfaces of the main blades 2*b* in the circumferential direction are integrally formed on one surface of the main plate 2*a* as shown in FIG. 5A and FIG. 6A in the same manner. FIG. 5A and FIG. 6A are views seen through the main blade shroud 2*c* in the same manner as FIG. 2A.

Figure 5C:
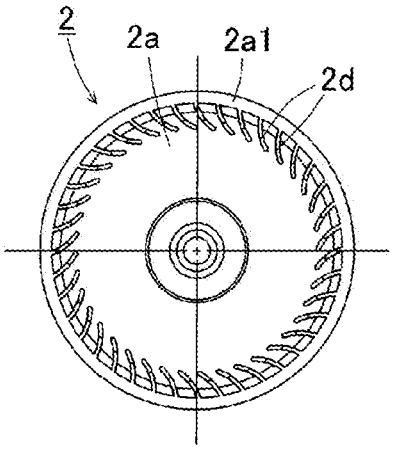
Figure 6A:
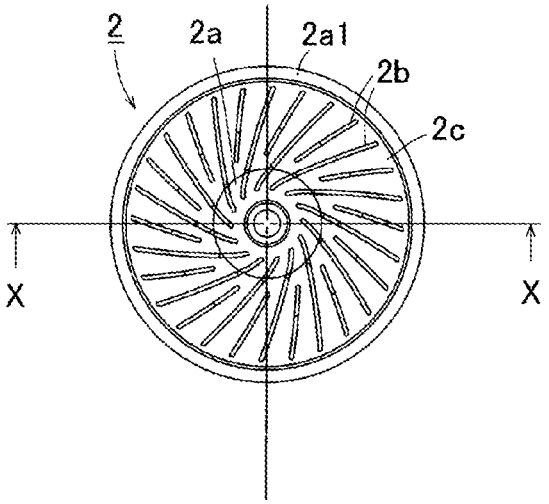
FIGS. 6A to 6C are a plan view, a cross-sectional view taken along X-X direction, and a back view, of the impeller according to another example, respectively.
Figure 6B:
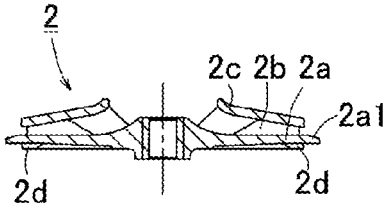
Figure 6C:
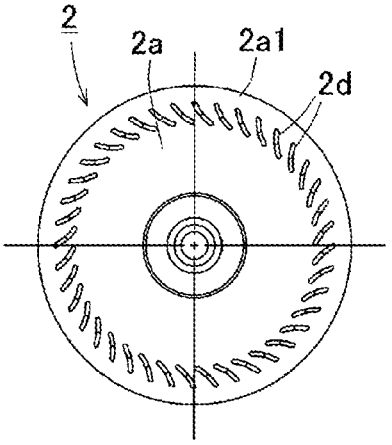

As shown in FIGS. 5B and 5C and FIGS. 6B and 6C, the auxiliary blades 2*d* formed on the other surface of the main plate 2*a* may be formed partially at least on an extended part provided to extend to the inside of the discharge flow path 8*a* to which the main plate 2*a* faces. Outer peripheral end portions of the auxiliary blades 2*d* may be connected to one another in the circumferential direction as shown in FIG. 5C. The outer peripheral end portions of the auxiliary blades 2*d* may also be separated from one another as shown in FIG. 6C.

Accordingly, the fluid returning to the impeller 2 along the wall surface of the discharge flow path can be fed to the discharge flow path 8*a* again after being accelerated by the auxiliary blades 2*d* and the structure of the impeller 2 can be simplified.

The present invention is effective as long as the auxiliary blades 2*d* are formed only in the discharge flow path 8*a* as shown in FIGS. 5A to 5C and FIGS. 6A to 6C. The efficiency of the blower can be increased by providing the auxiliary blades 2*d* so as to extend from the vicinity of the shaft hole of the main plate 2*a* to the outer peripheral edge portion 2*a*1 as shown in FIGS. 1A to 1C and FIGS. 3A to 3C.

Figure 7A:
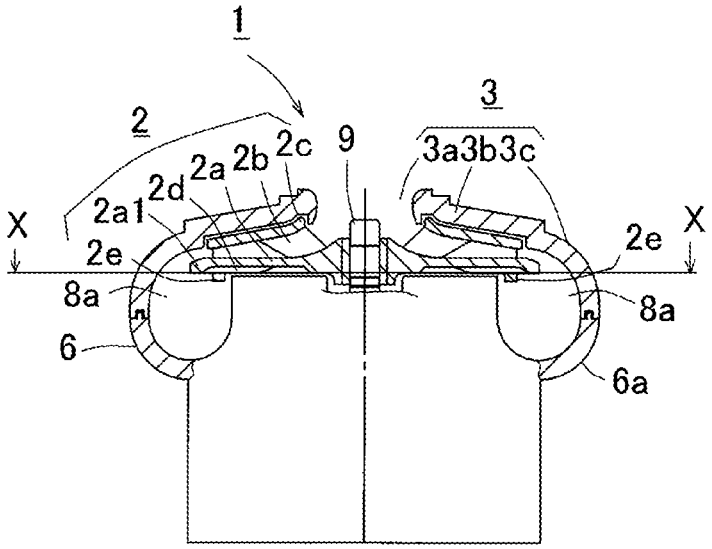
FIGS. 7A and 7B are a cross-sectional view of a relevant part of the blower according to another example and an explanation view for a shape of an auxiliary shroud thereof, respectively.
Figure 7B:
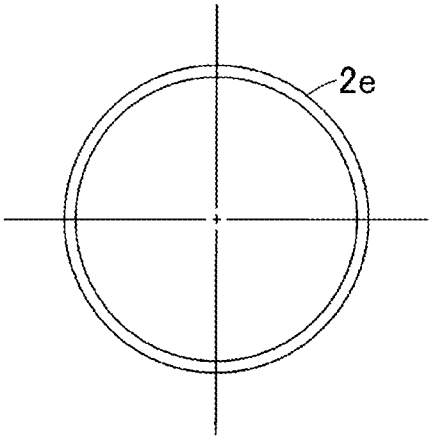

FIGS. 7A and 7B are a cross-sectional view of a relevant part of the blower according to another example and an explanation view for a shroud shape thereof, respectively. The same signs are given to the same members as those of the impeller 2 shown in FIGS. 2A to 2C, and explanation thereof is invoked. As shown in FIG. 7A, the main blades 2*b* and the main blade shroud 2*c* covering respective standing end surfaces of the main blades 2*b* in the circumferential direction are integrally formed on one surface of the main plate 2*a*, and the auxiliary blades 2*d* are formed on the other surface in the same manner.

As shown in FIG. 7A, an annular auxiliary blade shroud 2*e* in which respective standing end surfaces of the auxiliary blades 2*d* are connected in the circumferential direction is integrally formed. That is, the plural auxiliary blades 2*d* and the auxiliary blade shroud 2*e* covering the auxiliary blades 2*d* are provided on the outer peripheral edge portion 2*a*1 of the main plate 2*a* facing the discharge flow path 8*a*. FIG. 7B is a cross-sectional view taken along X-X direction showing only a portion relating to the auxiliary blade shroud 2*e*.

Accordingly, the fluid returning to the impeller 2 along the wall surface of the discharge flow path can be easily accelerated again and fed to the discharge flow path 8*a* by the auxiliary blades 2*d* by guiding the fluid between the auxiliary shroud 2*e* and the main plate 2*a*.

Figure 8A:
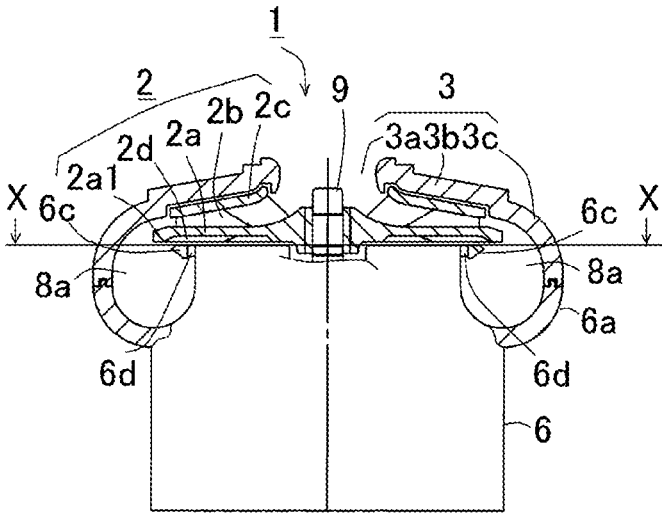
FIGS. 8A and 8B are a cross-sectional view of a relevant part in an axial direction of the blower according to another example and an explanation view for a shape of a housing-side auxiliary shroud thereof, respectively.
Figure 8B:
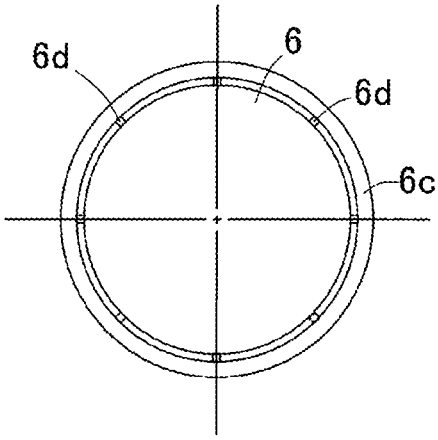

FIGS. 8A and 8B are a cross-sectional view of a relevant part of the blower according to another example and an explanation view for a shape of a housing-side auxiliary shroud thereof, respectively. FIG. 8B is a cross-sectional view taken along X-X direction showing only a portion relating to a housing-side auxiliary shroud 6*c*. The same signs are given to the same members as those of the impeller 2 shown in FIGS. 2A to 2C, and explanation thereof is invoked. As shown in FIG. 8A, the main blades 2*b* and the main blade shroud 2*c* covering respective standing end surfaces of the main blades 2*b* in the circumferential direction are integrally formed on one surface of the main plate 2*a*, and the auxiliary blades 2*d* are formed on the other surface in the same manner.

As shown in FIG. 8A, the housing-side auxiliary shroud 6*c* is formed on the wall surface of the flow path in the second housing 6 forming the discharge flow path 8*a* so as to face the auxiliary blades 2*d*. The annular housing-side auxiliary shroud 6*c* is integrally formed on the inner wall surface of the second curved portion 6*a* forming the discharge flow path 8*a* in the second housing 6. As shown in FIG. 8B, the housing-side auxiliary shroud 6*c* is integrally connected to the wall surface of the second curved portion 6*a* by a plurality of connecting parts 6*d* in the circumferential direction.

Accordingly, the fluid returning to the impeller 2 along the wall surface of the discharge flow path can be easily accelerated again and fed to the discharge flow path 8*a* by the auxiliary blades 2*d* by allowing the fluid to pass between the housing-side auxiliary shroud 6*c* and the second curved portion 6*a* to be guided between the housing-side auxiliary shroud 6*c* and the main plate 2*a*.

Figure 9:
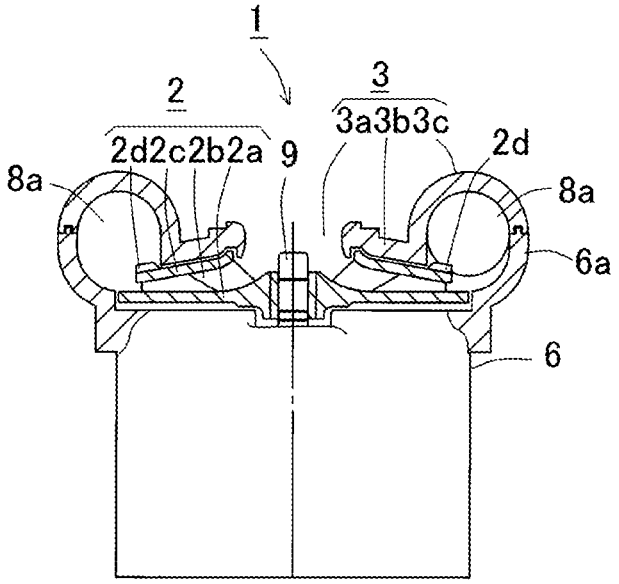
FIG. 9 is a cross-sectional view of a relevant part of the blower in the axial direction according to another example.

FIG. 9 is a cross-sectional view of a relevant part of the blower according to another example. The same signs are given to the same members as those of the impeller 2 shown in FIGS. 2A to 2C, and explanation thereof is invoked. As shown in FIG. 9, the discharge flow path 8*a* is provided to be biased to the first housing 3, not to the second housing 6 from the impeller 2 in the axial direction. The impeller 2 is formed so that the main blades 2*b* and the main blade shroud 2*c* covering respective standing end surfaces of the main blades 2*b* are integrally formed on one surface of the main plate 2*a* in the same manner.

In the present embodiment, not only the outer peripheral edge portion 2*a* 1 of the main plate 2*a* but also an outer peripheral edge portion of the main blade shroud 2*c* are extended and face the discharge flow path 8*a*. Therefore, the auxiliary blades 2*d* are integrally formed to stand on the outer peripheral edge portion of the main blade shroud 2*c* in which respective standing end surfaces of the main blades 2*b* are connected in the circumferential direction.

In the above case, the fluid returning to the impeller 2 along the wall surface of the discharge flow path can be accelerated again and fed to the discharge flow path 8*a* by the auxiliary blades 2*d* when outside air is sucked from the intake port 3*a* of the first housing 3 and guided by the main blades 2*b* to be fed to the circling discharge flow path 8*a* after being accelerated.

Figure 10A:
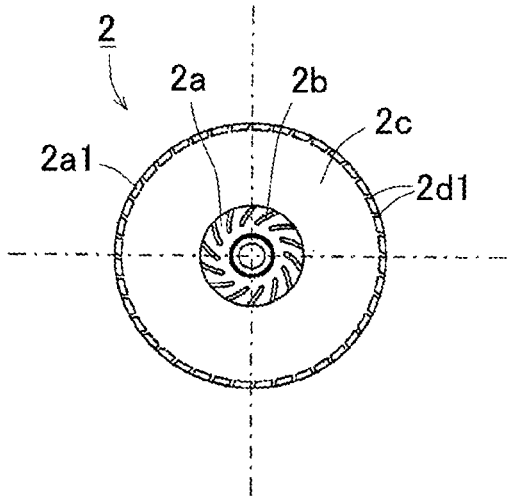
FIGS. 10A to 10C are a plan view of the impeller according to another example, a cross-sectional view of a relevant part of the blower in the axial direction and a back view of the impeller, respectively.
Figure 10B:
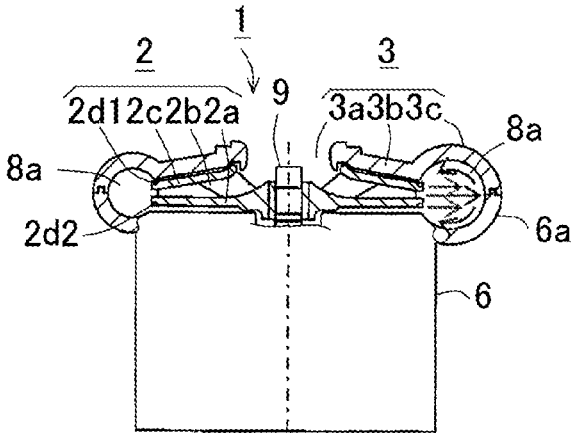
Figure 10C:
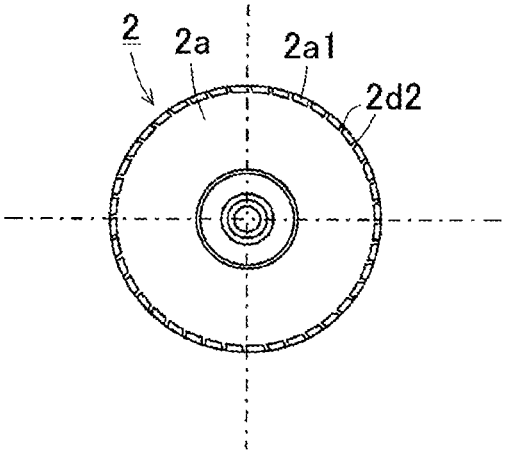

FIGS. 10A to 10C are a plan view of the impeller according to another example, a cross-sectional view of a relevant part of the blower in the axial direction, and a back view of the impeller, respectively. The same signs are given to the same members as those of the impeller 2 shown in FIGS. 2A to 2C, and explanation thereof is invoked. As shown in FIG. 10B, the discharge flow path 8*a* is provided on an outer side of the impeller in the radial direction at a boundary between the first housing 3 and the second housing 6. The impeller 2 is formed so that the main blades 2*b* and the main blade shroud 2*c* covering respective standing end surfaces of the main blades 2*b* are integrally formed on one surface of the main plate 2*a* in the same manner.

As shown in FIGS. 10A and 10C, both the outer peripheral edge portion 2*a*1 of the main plate 2*a* and the outer peripheral edge portion of the main blade shroud 2*c* are extended and face the discharge flow path 8*a* in the case of the present embodiment. Accordingly, the auxiliary blades 2*d* are formed on both of the outer peripheral edge portion 2*a*1 of the main plate 2*a* and the outer peripheral edge portion of the main blade shroud 2*c* facing the discharge flow path 8*a*.

Auxiliary blades 2*d*1 are formed on the outer peripheral edge portion of the main blade shroud 2*c* provided on the main plate 2*a*, and auxiliary blades 2*d*2 are formed on the outer peripheral edge portion 2*a*1 of the main plate 2*a* on a surface opposite to the main blades 2*b*.

Accordingly, the fluid returning to the outer peripheral edge portion of the impeller 2 along the wall surface of the discharge flow path can be accelerated again by the auxiliary blades 2*d*1 and 2*d*2 respectively provided on both sides of the main plate 2*a* and fed to the discharge flow path 8*a*.

As explained above, outside air is sucked from the intake port 3*a* of the first housing 3 by the rotation of the impeller 2 and guided by the main blades 2*b* to be fed to the circling discharge flow path 8*a* circling on the outer peripheral side after being accelerated. The fluid returning to the impeller 2 along the inner wall surface of the discharge flow path can be fed to the discharge flow path 8*a* along the outer peripheral edge portion 2*a*1 of the main plate 2*a* facing the discharge flow path 8*a*. In particular, when the auxiliary blades 2*d* are formed to stand at least on the outer peripheral edge portion 2*a*1 of the impeller 2 facing the discharge flow path 8*a*, the fluid fed from the impeller 2 to the discharge flow path 8*a* can be accelerated and fed to the discharge flow path 8*a* again by the auxiliary blades 2*d* even when the fluid returns to the impeller 2 along the inner wall surface of the discharge flow path.

Accordingly, characteristics in which the pressure is reduced as the flow rate is increased in pressure-flow rate characteristics in the case where the impeller 2 rotates at a given rotation speed can be realized.

The auxiliary blades 2*d* provided on the outer peripheral edge portion 2*a* 1 of the impeller 2 may be provided on the main plate 2*a*, on the main blade shroud 2*c* or on both members according to the arrangement of the discharge flow path 8*a* provided so as to circle in the case body 8.

Though the rolling bearing is cited as an example of the bearing 10, the bearing is not limited to this. Other sliding bearings such as a fluid dynamic pressure bearing and a sintered oil retaining bearing may be used.

What is claimed is:

1. A blower in which an impeller and a motor driving the impeller to rotate are housed in housings, and outside air is sucked from an intake port provided at a central part in the housings in an axial direction by rotation of the impeller and is discharged from a discharge port of a discharge flow path scrolling on an outer side in a radial direction, wherein the impeller includes a main plate formed in a disc shape, and a plurality of main blades and auxiliary blades, the main blades are formed to stand on one surface of the main plate and the auxiliary blades are formed to stand on another surface of the main plate and extend from a vicinity of a shaft hole to a position located in an outer peripheral edge portion of the main plate, wherein the auxiliary blades face an inside of the discharge flow path, the impeller extends to a position facing the discharge flow path, which is formed in an annular shape and arranged thereunder in the axial direction on the outer peripheral side thereof, the auxiliary blades include both long blades and short blades which are alternately arranged around the impeller in the circumferential direction, the long blades extend from a vicinity of the rotor shaft hole in the central portion to an outer peripheral edge portion to a position facing the discharge flow path, wherein the long blades face the inside of the discharge flow path, and the short blades extend from a middle part of the main plate in the radial direction to the outer peripheral edge portion, and respective standing end surfaces of the auxiliary blades are connected in the circumferential direction to integrally form an auxiliary blade shroud.

2. The blower according to claim 1, wherein an outer peripheral edge portion of the main plate is formed to be curved toward the inside of the discharge flow path.

3. The blower according to claim 1, wherein the auxiliary blades are formed on both of the main plate and the main blade shroud.

4. The blower according to claim 1, wherein a housing-side auxiliary shroud fixed to the housings is formed at a position facing the auxiliary blades inside the discharge flow path provided in the housings.

* * * * *